US006705344B2

(12) United States Patent
Poirier

(10) Patent No.: US 6,705,344 B2
(45) Date of Patent: Mar. 16, 2004

(54) POTABLE WATER CIRCULATION SYSTEM

(76) Inventor: Blair J. Poirier, 22 Leandre Road, Shediac Bridge, New Brunswick (CA), E4R 1M5

( * ) Notice: Subject to any disclaimer, the term of this patent is extended or adjusted under 35 U.S.C. 154(b) by 85 days.

(21) Appl. No.: 10/098,539

(22) Filed: Mar. 18, 2002

(65) Prior Publication Data

US 2002/0139421 A1 Oct. 3, 2002

(30) Foreign Application Priority Data

Mar. 27, 2001 (CA) ..... 2,342,389

(51) Int. Cl.[7] ..... E03B 1/02

(52) U.S. Cl. ..... 137/563; 137/561 A; 137/565.35; 137/876

(58) Field of Search ..... 137/563, 561 A, 137/565.01, 565.35, 876

(56) References Cited

U.S. PATENT DOCUMENTS

| | | | | |
|---|---|---|---|---|
| 715,266 A | | 12/1902 | Heston | |
| 920,559 A | | 5/1909 | Fleming | |
| 2,445,414 A | | 7/1948 | Zabriskie | |
| 2,582,802 A | | 1/1952 | Terrell | |
| 2,725,892 A | | 12/1955 | Gallistel | |
| 2,921,604 A | | 1/1960 | Zettl | |
| 3,166,098 A | | 1/1965 | Jennings | |
| 3,285,272 A | * | 11/1966 | Messenger | 137/563 |
| 3,481,365 A | | 12/1969 | Keen | |
| 3,746,027 A | * | 7/1973 | Elliott | 137/1 |
| 3,754,741 A | | 8/1973 | Whitehurst | |
| 3,913,606 A | * | 10/1975 | Anderson, Jr. | 137/205 |
| 4,340,308 A | | 7/1982 | Tharp | |
| 4,457,326 A | | 7/1984 | Donnelly | |
| 4,481,966 A | | 11/1984 | Anderson | |
| 4,593,716 A | * | 6/1986 | Cesna | 137/561 A |
| 4,606,325 A | * | 8/1986 | Lujan, Jr. | 126/362 |
| 4,672,990 A | | 6/1987 | Rubillard | |
| 4,702,269 A | | 10/1987 | Schuler | |
| 4,790,289 A | | 12/1988 | Barrett | |
| 4,917,146 A | | 4/1990 | Sundheimer | |

(List continued on next page.)

FOREIGN PATENT DOCUMENTS

| | | |
|---|---|---|
| CA | 618 781 | 4/1961 |
| CA | 660117 | 3/1963 |
| CA | 937178 | 11/1973 |
| CA | 946251 | 4/1974 |
| CA | 997980 | 10/1976 |
| CA | 1039769 | 10/1978 |
| CA | 2193494 | 12/1999 |

OTHER PUBLICATIONS

Authors: Bruce R. Munson Donald F. Young Theodore H. Okiishi Title: "Fundamentals of Fluid Mechanics", Third Edition Publisher: John Wiley & Sons, Inc New–York Publication Date: 1998 Relevant Pages: pp. 489–529 and 853.

*Primary Examiner*—A. Michael Chambers
(74) *Attorney, Agent, or Firm*—Mario Theriault

(57) ABSTRACT

The present invention relates to systems for circulating water in a potable water piping network to prevent the stagnation of water in this piping network. Several systems are disclosed wherein partitioned pipes, pumps, partitioned headers, check valves, and scoop inserts are used to keep the water in movement inside the pipes. The present invention comprises several pumping arrangements for circulating water inside fire hydrant laterals and inside the branch pipes along dead-end streets where most of the water stagnation occurs. Although partitioned pipes are used and opposite flows are induced in opposite pipe halves, full pipe flow to each hydrant is maintainable in case of emergency. Inside buildings, the water is kept in movement inside a loop pipe that extends close to each water outlet such that the water is maintained fresh at each outlet.

22 Claims, 6 Drawing Sheets

U.S. PATENT DOCUMENTS

| | | | | | |
|---|---|---|---|---|---|
| 4,945,942 | A | * | 8/1990 | Lund | 137/337 |
| 4,995,123 | A | | 2/1991 | Kern | |
| 5,029,612 | A | | 7/1991 | Simbulan | |
| 5,032,290 | A | | 7/1991 | Yamagata | 210/747 |
| 5,287,876 | A | | 2/1994 | Takahashi | 137/62 |
| 5,311,904 | A | | 5/1994 | Beppu | 137/561 |
| 5,314,619 | A | | 5/1994 | Runyon | 210/606 |
| 5,476,118 | A | | 12/1995 | Yokoyama | 137/599 |
| 5,622,207 | A | | 4/1997 | Frank | 137/899.2 |
| 5,699,859 | A | | 12/1997 | Poirier | 166/112 |
| 6,062,259 | A | | 5/2000 | Poirier | 137/563 |

* cited by examiner

POTABLE WATER CIRCULATION SYSTEM

FIELD OF THE INVENTION

This invention pertains to installations for circulating water in potable water piping systems and more particularly in the fire hydrants and dead ends of a municipal water distribution network.

BACKGROUND OF THE INVENTION

It is well known that microorganisms and suspended solids in potable water vary widely in composition depending on the source, and form microbial growth and sedimentation on the surfaces of piping and reservoirs wherever the water is contained. It is also well known that the sedimentation and the accumulation of microbial growth in still water promote the proliferation of various bacteria and cause the contamination of the water.

Plumbing regulations and plumbing codes are very explicit about preventing cross connections in a piping system and generally, licensed plumbers are apprehensive of these problems. A 'cross connection' is defined in plumbing code books as any actual or potential connection between a potable water system and any source of pollution or contamination.

It is generally well accepted that stagnant water should always be considered contaminated and non-potable. Further, it is believed that stagnant water is not only found in marshes and ponds, but is also found in water distribution piping systems and reservoirs that do not have sufficient flow to keep the water active, where water remains still for long period of time for example. Although the fact is often neglected, decaying water in a piping system is in direct contact with potable water and represents a cross-connection contamination that is believed to be harmful to the health of users supplied in water by that piping system.

Generally, municipal water distribution systems are flushed periodically to discharge stagnant water. It is often the case that the discharged water has a foul odor and filthy discoloration. Despite these periodic flushes, it is believed that the stagnation of water in municipal piping systems is a major cause of bad water taste, buildup of sediments in residential hot water reservoirs, and microbial growth in toilet reservoirs and in the drains of bathroom accessories. It is further believed that stagnant water in a piping system is a source of many persistent illnesses, digestive problems and the beginning of many diseases to those using and drinking water from these systems.

Another reason for periodically flushing water distribution systems is to eliminate concentrations of chlorine or other disinfectant used in water supply systems which tend to accumulate at regions of low flow or of stagnation. In addition to being detrimental to a good health, high concentrations of chlorine in particular, are known to change the PH value of the water and to deteriorate the protective coating inside water pipes. The material of fabrication of the pipes, which may contain traces of toxin substances are then exposed to the potable water.

The problem of water stagnation is particularly noticeable near water hydrants for example and at the ends of long branches of a piping system where the number of users on a branch pipe is not sufficient for ensuring a proper circulation of water. These situations are often found in newer or partly built subdivisions, and at the end of streets which are supplied in water by oversized pipes. Furthermore, a number of municipalities have water supply systems that were designed according to fire fighting requirements. The size of many branch pipes in these systems is often too large to ensure an adequate circulation of water within the pipe under normal conditions.

The problem of stagnant water in potable water distribution systems has been partly addressed in the past, as can be appreciated from the following prior art documents:

U.S. Pat. No. 2,445,414 issued on Jul. 20, 1948 to W. F. Zabriskie et al. This document discloses a partitioned riser pipe leading to a hydrant, in which water is circulated upward in one side of the pipe and down in the other side. The partitioned pipe is used to circulate water in the casing of the hydrant to prevent freezing of the water inside the hydrant head.

U.S. Pat. No. 3,481,365 issued on Dec. 2, 1969 to A. R. Keen. This patent discloses various partitions in a piping system to divert the water flow near the branch valves in that piping system. The partitions are used to prevent stagnation of water near the branch valves.

U.S. Pat. No. 5,476,118 issued on Dec. 19, 1995 to Ikuo Yokoyama. This document discloses the use of a venturi eductor and venturi tube in an active water pipe to draw water from a valve body in a branch pipe connected to this water pipe, to prevent stagnation of water in the valve body.

U.S. Pat. No. 6,062,259 issued on May 16, 2000 to Blair J. Poirier; the applicant of the present patent application. This document describes a system for recirculating water in the branches of a municipal water distribution system. The main feature of this invention consists of a pumping system having means to draw water from the far end of a branch pipe relative to the water main and to convey this water into the near end of the branch pipe to circulate the water in the branch pipe.

CA 2,193,494 issued on Dec. 07, 1999 to Perry et al. This document discloses a method of cleaning and maintaining potable water distribution pipe system with a heated cleaning solution. The heated cleaning solution is circulated in the piping system to dislodge and flush all accumulated contaminants.

Although substantial efforts have been made in the past to propose solutions to prevent the stagnation of water in piping systems, these proposals continue to be treated with uncertainty by water system designers. For this reason basically, it is believed that there continues to be a need for a better solution which is more practicable than the prior art proposals.

SUMMARY OF THE INVENTION

In the present invention, however, there is provided three potable water circulation systems which are related to each other due to several common features. The potable water circulation systems according to the present invention are relatively easy to build, easy to install and to operate. The water circulation systems according to the present invention are believed to be compatible with the current waterworks design practices and fire prevention requirements of a municipal water distribution system.

Broadly, in accordance with one aspect of the present invention, there is provided a potable water circulation system for circulating water in a municipal water distribution network which has a water main and at least one branch pipe extending from the water main. As it is often the case, the branch pipe has a dead end therein at a distance from the water main. The potable water circulation system comprises a conduit system inside the branch pipe, connected to the dead end and to the water main for circulating water from the water main to the dead end and back into the water main. The potable water circulation system also comprises a pump and check valve arrangement connected to the conduit system to cause a minimal circulation of water in the conduit system when a water demand in the branch pipe is lower than the nominal capacity of the pump, and to cause the circulation to reverse when the demand in the branch pipe exceeds the nominal capacity.

The major advantage of this circulation system is that the minimal circulation through the dead end of the branch pipe during low demand periods eliminate the risk of water stagnation in this dead end, while allowing full pipe flow in the branch pipe in the case of an emergency when a fire hydrant is opened for example.

In accordance with another aspect of the present invention, the conduit system is formed by a partition inside the branch pipe and a return gap in this partition at the dead end. One of the advantages associated with such partitioned pipe of that its installation does not require more excavation work than the installation of a conventional municipal water distribution pipe.

In accordance with another aspect of the present invention, there is provided a potable water circulation system for circulating water in a municipal water distribution network comprising a water main and a branch pipe extending from the water main and having a dead end therein at a distance from the water main. The potable water circulation system comprises a first longitudinal partition mounted inside the branch pipe and defining a first and second pipe halves, and a first gap in the first longitudinal partition at the dead end. The potable water circulation system also has a first and second takeoff pipes connected respectively to the first and second pipe halves and separately to the water main. A check valve is mounted in the first takeoff pipe. The check valve has an unchecked side near the water main and a checked side away from the water main. There is also provided a pump having an intake pipe and a discharge pipe connected to the first takeoff pipe, astride the check valve, on the unchecked and checked sides respectively. The pump is operable to cause a circulation of water from the water main, into the first pipe half, through the first gap and back to the water main along the second pipe half, to prevent water stagnation in the dead end.

In yet another aspect of the present invention, there is provided a fire hydrant lateral connected to the branch pipe. This fire hydrant lateral has a second longitudinal partition therein defining a third and fourth pipe halves there along. The fire hydrant lateral also has a hydrant base defining an end thereof and a second gap in the second longitudinal partition in the hydrant base. In this aspect of the present invention, the third and fourth pipe halves communicate with the first pipe half and form with the first pipe half and the second gap a serial conduit.

In yet a further aspect of the present invention, the fire hydrant lateral connected to the branch pipe comprises a directional/bypass valve to selectively direct a flow of water along the third and fourth pipe halves there through, and divert a flow of water from the third pipe half to the fourth pipe half.

In yet another aspect of the present invention, the directional/bypass valve comprises a butterfly valve having an upstream side and a downstream side, and partitioned adapters mounted on the upstream and downstream sides. These adapters have a simple structure manufacturable by conventional metalworking processes or by moulding or casting for examples. This directional/bypass valve is thereby manufacturable with commercially available components and tooling.

The potable water circulation systems according to present invention reduces the difficulties and disadvantages of the prior art water circulation proposals, as the circulation systems described herein are compatible with conventional design and installation practices applicable in this field of waterworks. The potable water circulation systems according to the present invention are manufacturable using current technologies, and do not adversely affect the emergency capacity of a municipal water distribution network.

Other advantages and novel features of the present invention will become apparent from the following detailed description.

BRIEF DESCRIPTION OF THE DRAWINGS

Three embodiments of the present invention are illustrated in the accompanying drawings, in which like numerals denote like parts throughout the several views, and in which.

DETAILED DESCRIPTION OF THE PREFERRED EMBODIMENT

Figures 1, 2, 3:
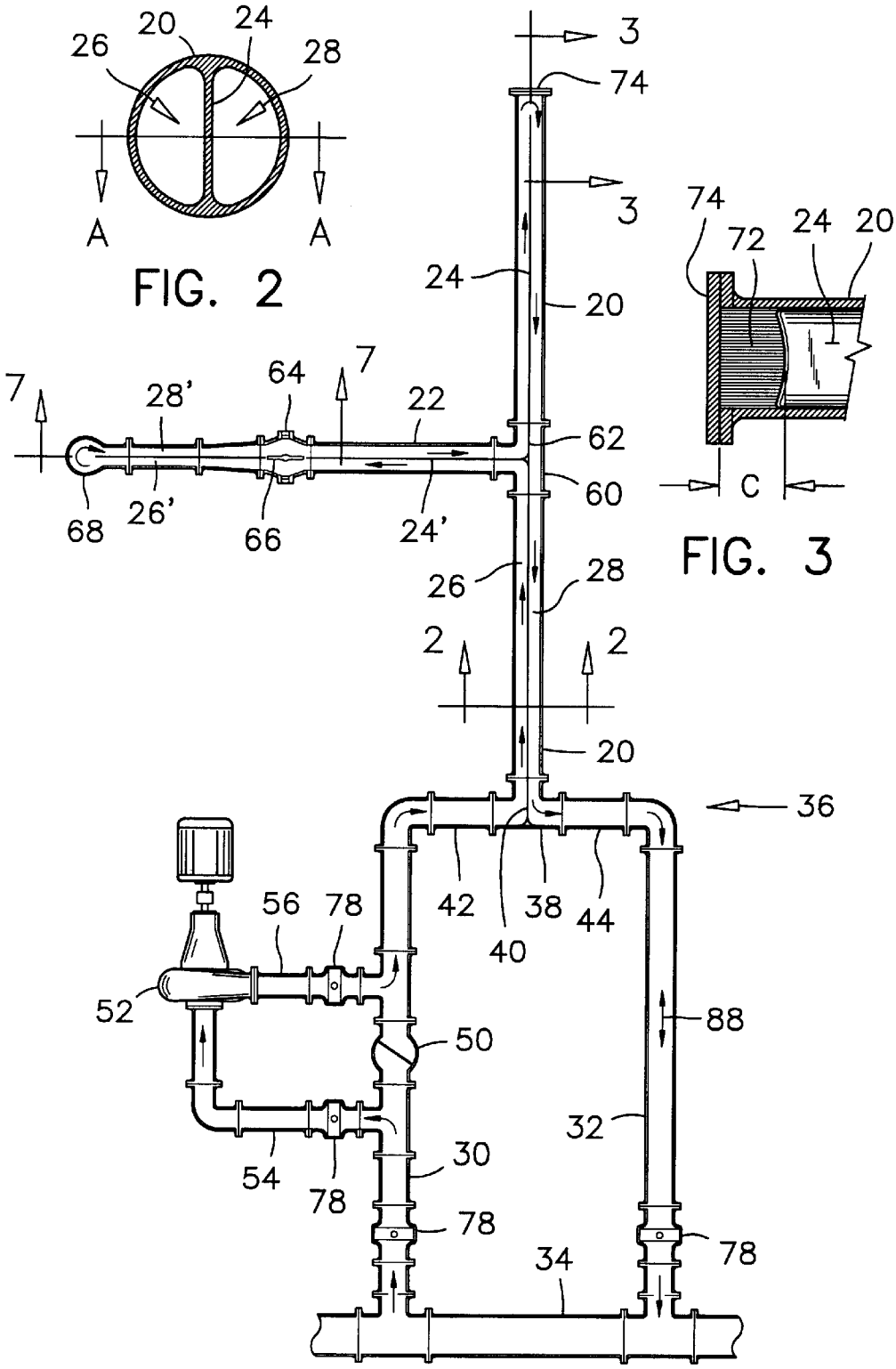
FIG. 1 is a cross-section view of a municipal water circulation system according to the first preferred embodiment of the present invention, including a water main, a branch pipe along a dead-end street, a fire hydrant lateral, and a pumping system to circulate water in the dead-end branches and in the base of fire hydrants.
FIG. 2 shows a cross-section view of the branch pipe shown in FIG. 1, taken along the line 2—2 in FIG. 1, and of all the other partitioned pipes shown in the accompanying drawings.
FIG. 3 is an illustration of the partition inside the branch pipe in FIG. 1, as seen when looking inside the end of the branch pipe, substantially along line 3—3 in FIG. 1.

While this invention is susceptible of embodiments in many different forms, there are illustrated in the drawings and will be described in details herein three specific embodiments of the present invention, with the understanding that the present disclosure is to be considered as an example of the principles of the invention and is not intended to limit the invention to the embodiments illustrated and described. The three embodiments are presented herein to better illustrate various manners of construction, installation and operation of the potable water circulation systems according to the present invention.

Referring firstly to FIGS. 1 to 3, the first preferred embodiment of the present invention applies to the circulation of water inside a long branch pipe 20 of a municipal water distribution system, such as along a secondary street, and in one or more fire hydrant laterals 22 extending from the branch pipe. Most importantly, the branch pipe 20 is a partitioned pipe as illustrated in FIG. 2, having a partition 24 there along dividing the pipe cross-section in two pipe halves 26, 28. The branch pipe 20 can be several hundred feet long and have numerous residential and commercial takeoffs connected there along. These takeoffs have not been illustrated because they do not constitute the focus of the present invention.

Figure 4:
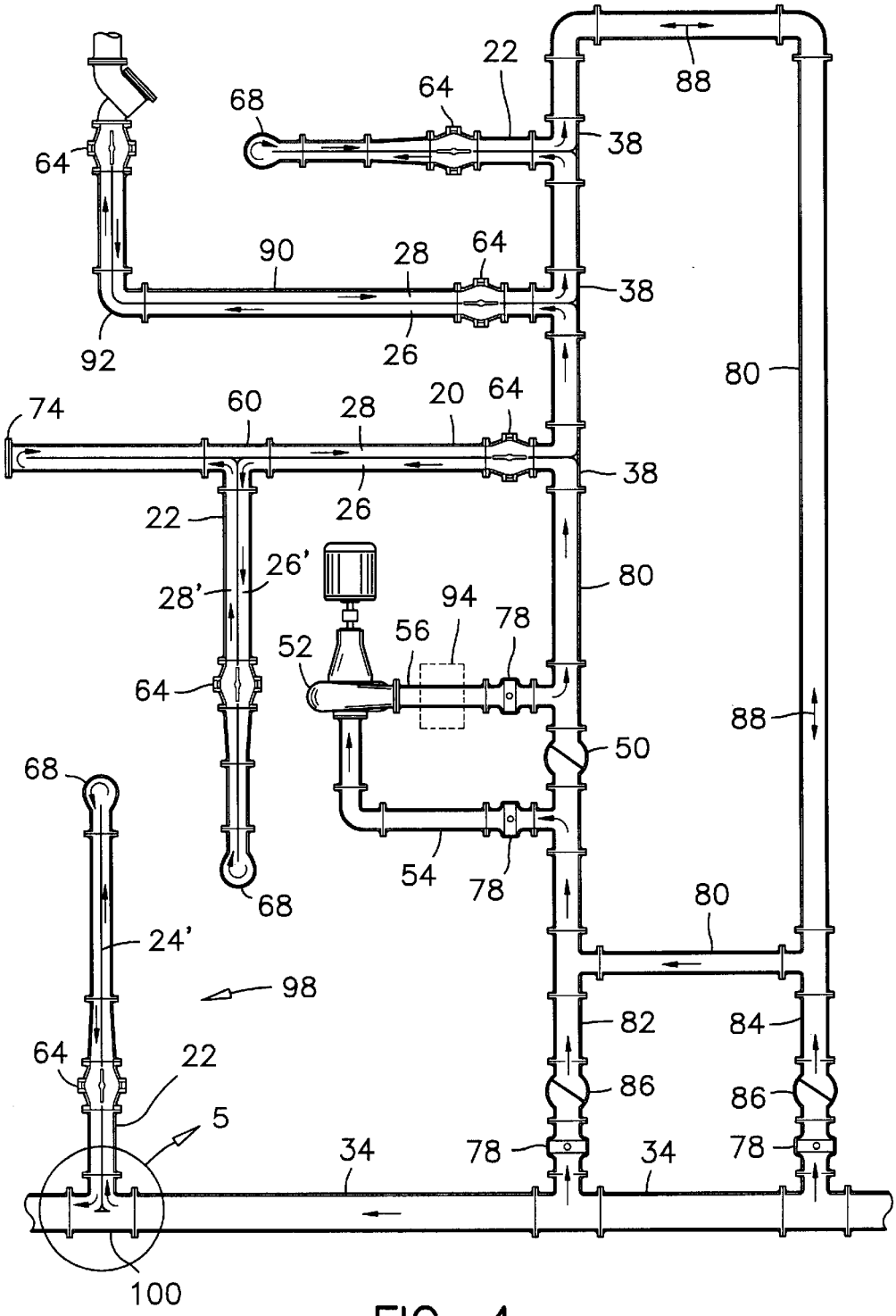
FIG. 4 is a cross-section view of a municipal water circulation system according to a second preferred embodiment of the present invention, including a water main, a closed-loop subdivision, a number of laterals including three fire hydrant laterals, a dead-end branch pipe, a supply pipe to the sprinkler system of a building, and a pumping system to circulate water in this closed-loop subdivision, laterals and branches.

The illustrations in FIGS. 1 and 4 in particular, represent cross-section plan views of a piping network as seen substantially along a median plane across the pipes such as along plane A—A in FIG. 2.

In the first preferred embodiment, a pair of spaced apart takeoff pipes 30, 32 extend from a water main 34 and are joined at a distance from the water main 34 by a crossover pipe 36. A first tee fitting 38 is mounted in the crossover pipe 36 and has a medial partition 40 extending along the takeoff section thereof and separating the straight section thereof and the crossover pipe 36 in two segments 42, 44, which respectively communicate with one of the pipe halves 26, 28 of the branch pipe 20.

A check valve 50 is mounted in the takeoff pipe 30. A pump 52 is provided to draw water from the water main 34 and to force this water into the branch pipe 20. The pump has an intake pipe 54 communicating with the takeoff pipe 30 on the unchecked side of the check valve 50 and a discharge pipe 56 communicating with the checked side of the valve 50.

In the embodiment illustrated in FIG. 1, the hydrant lateral 22 extends from a second tee fitting 60 which has a three-way partition 62 therein. The partition 62 joins the longitudinal partitions 24 in the branch pipe 20 to another longitudinal partition 24' in the hydrant lateral 22. A directional/bypass valve 64 is installed along the hydrant lateral 22, to selectively isolate the hydrant lateral from the branch pipe 20.

In this first preferred embodiment, the directional/bypass valve 64 is a butterfly valve in which the blade 66, when opened, constitutes a partition through the valve body to maintain straight the flow of water across the valve and along both pipe halves 26', 28' of the hydrant lateral 22.

Figure 7:
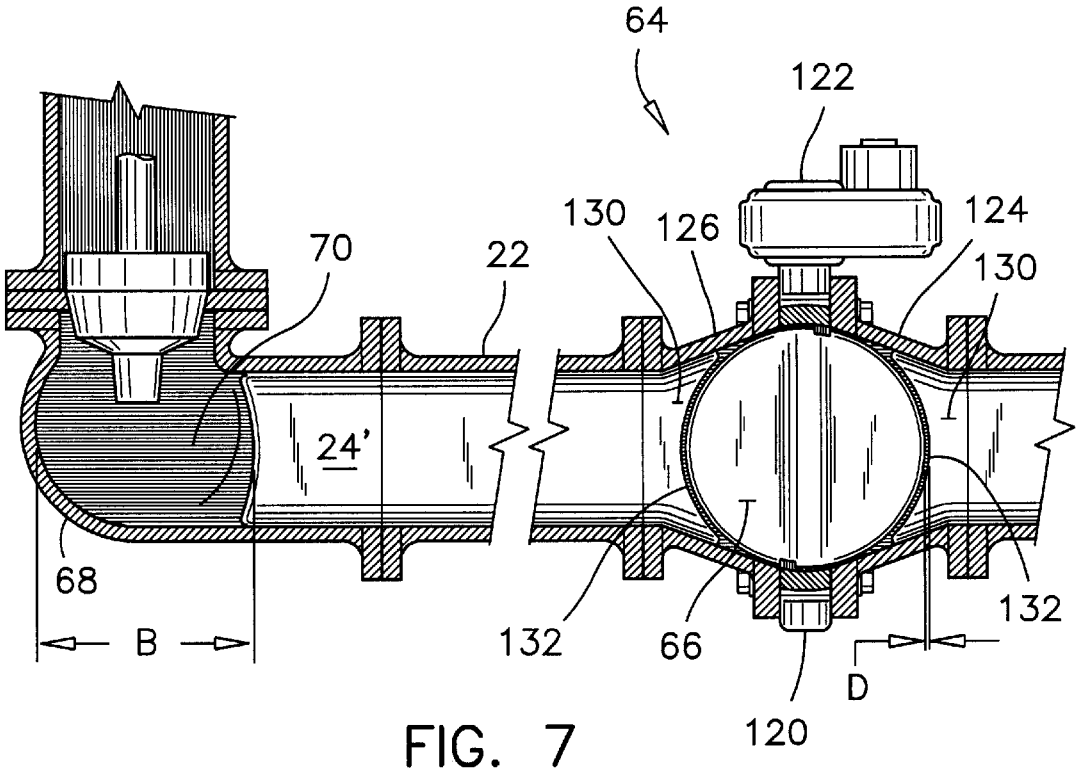
FIG. 7 is a cross-section view inside a fire hydrant lateral as seen when looking inside the fire hydrant lateral, substantially along line 7—7 in FIG. 1, showing the directional/bypass valve in an open position.

The partition 24' in the hydrant lateral 22 does not extend the full depth of the hydrant base 68 such that the water can circulate from one pipe half 26' into the hydrant base 68 and into the other pipe half 28'. For this purpose, the partition 24' defines a return gap 70 in the base of the hydrant 68, as illustrated in FIG. 7. This return gap 70 has a length 'B' and a height corresponding to the diameter of the pipe 22. The dimension 'B' is determined to provide with the diameter of the pipe 22, an open area inside the hydrant base 68 which is larger than the cross-section area of one of the pipe halves 26', 28'. The dimension 'B' is also selected to provide this return gap 70 with a low friction coefficient similar to a smooth return bend.

It should be noted that the three-way partition 62 in the second tee fitting 60 intersects the first pipe half 26 in the branch pipe 20. The return gap 70 and the pipe halves 26',28' form a serial conduit with the first pipe half 26 to circulate water in and out of the hydrant lateral 22. When the pump 52 operates, a forced circulation of water is established along the pipe halves 26, 26', through the hydrant base 68, and along the other pipe half 28', to prevent the stagnation of water in the hydrant base 68.

A similar return gap 72 having a length 'C' and a height corresponding to the diameter of the branch pipe 20 is formed in the end portion 74 of the branch pipe 20. The return gap 72 is illustrated in FIG. 3. The dimension 'C' of the return gap 72 is also determined to limit pressure losses in the flow of water through this gap.

As it will be appreciated, the operation of the pump 52 causes the water to circulate from the water main 34, into the first takeoff pipe 30; along a first pipe half 26 of the branch pipe 20 and the along the first pipe half of the hydrant lateral 22; into the hydrant base 68; inside the dead end 74 of the branch pipe; and back into the water main 34 through the second takeoff pipe 32. Gate valves 78 may be provided along the takeoff pipes 30, 32 and along the intake and discharge pipes 54, 56 of the pump to control the flow of water through these pipes.

The capacity of the pump 52 is selected to provide a head which is about 10–12 feet above the highest elevation along the piping system in which the water is circulated, and a preferred flow velocity along each pipe half 26, 28 of at least about 0.1 ft/sec.

It will be appreciated that when the demand of water is large in the branch pipe 20 such as when a fire hydrant is opened, the water can flow freely through the check valve 50 along the takeoff pipe 30 thereby bypassing the pump 52. In these circumstances, the flow in the second takeoff pipe 32 is reversed and the flows in both pipe halves 26, 28 are oriented toward the point of use to supply this demand surge. Therefore, in high demand periods or in emergency situations, the maximum flow of water along the branch pipe 20 and along the hydrant lateral 22 is substantially the same as the capacity of an unpartitioned pipe, being only reduced by the thickness of the partition 24. Because of the arrangement of the pump 52 mounted astride the check valve 50, and of the takeoff pipes 30,32, the force circulation system is present only in low water demand periods when the water is susceptible of stagnation.

Referring now to FIG. 4, a second preferred embodiment of the present invention is illustrated therein. In this embodiment, a pump 52 and check valve 50 are mounted along a closed loop pipe 80, such as around a subdivision in a municipal water distribution system, to cause a circulation along the closed loop pipe 80. Again, the closed the loop pipe 80 can extend several hundred feet and may have numerous secondary takeoffs there along which have not been illustrated. In some configurations, the closed loop pipe 80 may be formed by the water distribution pipes extending along two parallel streets for example, with a crossover pipe at the far end or at both ends of the streets.

The closed loop pipe 80 is connected to a water main 34 by means of two takeoff pipes 82, 84 each having a check valve 86 mounted therein. Each of the check valves 50 and 86 has an unchecked side toward the water main 34 and a checked side away from the water main. Water is free to flow from the water main 34 through all three check valves in peak demand periods, as previously explained and as illustrated by the double-headed arrows 88. In low water demand periods, the pump 52 maintains a minimum flow along the closed loop pipe 80 to prevent stagnation in the branches and laterals connected to this closed loop pipe.

In the illustration of FIG. 4, a combination of a branch pipe 20 and a hydrant lateral 22 is shown downstream from the pump 52. The branch pipe 20 is connected to the closed loop pipe 80 using a medially partitioned tee fitting 38. A same type of tee fitting 38 is also used to join a supply pipe 90 of a sprinkler system of a building to the closed loop pipe 80. One or more partitioned elbows 92 may be used along a partitioned pipe as can be appreciated from this illustration. The piping system illustrated in FIG. 4 also shows a hydrant lateral 22 connected directly to the closed loop pipe 80 in a similar manner using a medially partitioned tee fitting 38. It will be appreciated that in periods of strong water demand, such as when a fire hydrant is opened, the flow of water can come from both pipe halves of each partitioned pipe and around the return gap of every branch and hydrant lateral, to reach the point of high demand.

Another advantage of the potable circulating systems illustrated in FIGS. 1 and 4 is that there could be a water filtration system 94 mounted next the pump 52, to filter the water distributed to this particular subdivision or suburb. This filtration system 94 is illustrated in dashed lines because it is considered optional. Although a water filtration system is mentioned, this installation could comprise other water treatment systems such as a chlorination treatment system, a de-chlorination system, a fluorination system and an UV treatment system. This filtration system 94 is particularly appreciable to correct problems being developed in a water distribution system between the water treatment plant and the point of use.

It should be noted at this point that the illustrations in FIGS. 1 and 4 should not be scaled. As mentioned before, the branch pipe 20 and the closed loop pipe 80 shown therein can extend several hundred feet and have a number of hydrants and other laterals and residential takeoffs connected to them. Similarly, the lengths of the takeoff pipes 30, 32, 82, 84 can be limited to a few feet inside a pump house for example. The illustrations in FIGS. 1 and 4 depict the basic principles and operation of two circulation systems according to the present invention, in sufficient details to provide the person skilled in the art with the knowledge required to apply these concepts and principles to various configurations of municipal water distribution systems.

A hydrant lateral 22 may also be connected to the water main 34, using a partially partitioned tee fitting 100, as shown by label 98 on the lower left corner of FIG. 4. The partially partitioned tee fitting 100 is better illustrated in FIGS. 5 and 6. This tee fitting 100 consists of a regular tee fitting, in which there is mounted a scoop insert 102. The scoop insert 102 is mounted in the takeoff portion 104 of the tee fitting 100 and extends across the straight portion 106, a distance of about half the diameter of the straight portion. When the takeoff portion 104 is two (2) denominations smaller than the straight portion 106, six (6) inch and ten (10) inch respectively for example as it is customary with these takeoff tee fittings, and the flow in the water main is about 0.5 ft/sec, it is believed that the scoop insert 102 diverts about 4–5% of the flow in the water main into the hydrant lateral 22. This belief is based on theoretical pressure loss calculations made with principles and instructions found in an engineering manual entitled: Fundamentals of Fluid Mechanics, third Edition, by Munson, Young and Okiishi, published by John Wiley & Sons, Inc. 1998. When the hydrant lateral is connected to an active water main, a flow of this magnitude is considered sufficient to prevent water stagnation in the hydrant base 68.

The scoop insert 102 consists of a tubular element 108 enclosing a cross-like blade 110. The blade 110 has a two-way deflector 112 on its end, to divert a flow of water from either direction in the straight portion 106, and into the takeoff portion 104. The two-way deflector 112 defines the end of the blade 110 extending halfway across the straight portion 106. A flange 114 is provided around the tubular element 108.

The scoop insert 102 is preferably made of a mouldable plastic material. The dimension of the tubular element 108 and of the flange 114 are preferably selected to mount fitly into the takeoff portion 104 of a standard tee fitting. The tubular element 108 and the blade 110 extend outside the takeoff portion 104, beyond the flange 114. In use, the blade 110 is joined to or otherwise meets with the partition 24' inside the partitioned pipe 22. The joining of the blade 110 to the partition 24', or the joining of two adjoining partitions 24 is not illustrated herein because this could take numerous forms and does not constitute the focus of the present invention. The scoop insert 102 may be readily mounted in a standard tee fitting and fastened to the tee fitting by its flange 114 during the mounting of the tee fitting to an adjoining pipe.

As mentioned before, the fire hydrant lateral 98 illustrated in FIG. 4 is connected to an active water main 34 with a flow of about 0.5 ft/sec. It will be understood that this hydrant lateral 98 can also be connected to a closed loop pipe 80 around a subdivision. In this case, the pump 52 is selected to cause a flow in the closed loop pipe 80 which is sufficient for inducing a desired flow of water through the hydrant lateral 98.

Figure 5:
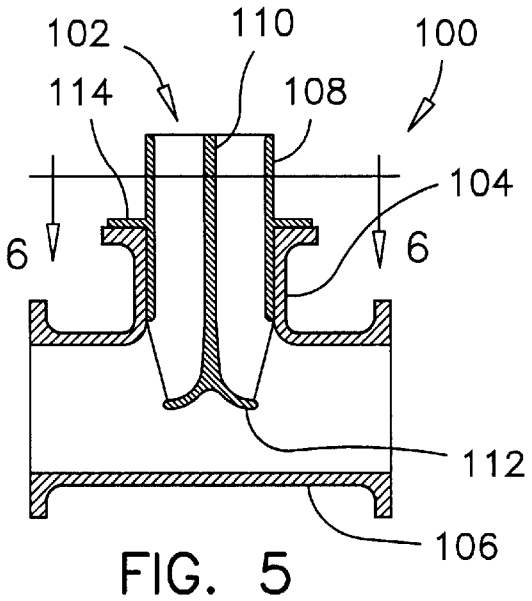
FIG. 5 illustrates a cross-section view of a scoop insert mounted inside the tee fitting shown in the detail circle 5 in FIG. 4.
Figure 6:
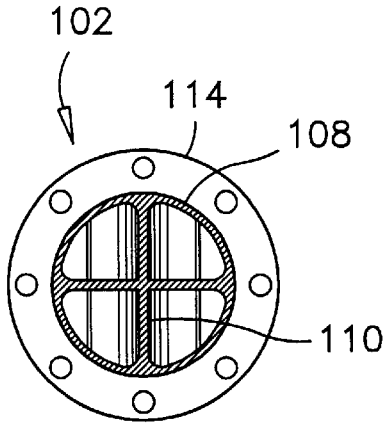
FIG. 6 is a cross-section view of the scoop insert as seen along line 6—6 in FIG. 5.

Although a flow of water in a hydrant lateral of about 4–5% of the flow in the water main is believed sufficient for preventing a stagnation of the water in the hydrant base 68, there may be some exceptional circumstances where a larger flow is required in a hydrant lateral. Also, there are cases where the flow in the water main is insufficient to induce a minimum flow through the tee connection 100 and the hydrant lateral 98. For these reasons, the arrangement illustrated in the lower left corner of FIG. 4 and in FIGS. 5 and 6, is believed to be appropriate for only a majority of hydrant laterals connected to water mains.

Figure 15:
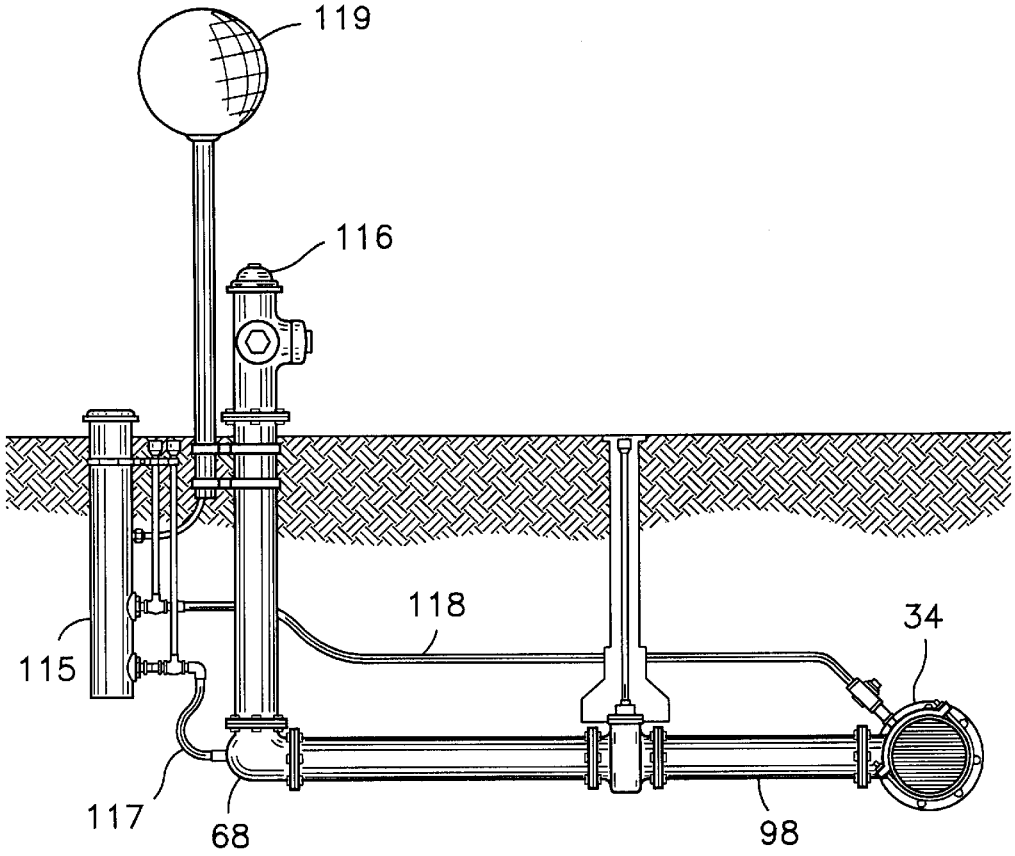
FIG. 15 illustrates an alternate embodiment for circulating water in a hydrant lateral extending from a water main such as illustrated in the lower left corner of FIG. 4.

In other exceptional cases, an alternate embodiment of a circulating system is proposed. This alternate embodiment is only remotely related to the present invention, but is nonetheless presented herein for convenience, to provide additional resources to the designers of the circulation systems according to the present invention. This alternate embodiment is illustrated in FIG. 15 and comprises a pumping unit 115 mounted next to the water hydrant 116 and having an intake pipe 117 connected to the hydrant base 68 and a discharge pipe 118 connected to the water main 34. This pumping unit 115 is described in U.S. Pat. No. 6,062,259 issued to the Applicant of the present application. This pumping unit 115 may be powered by an electrical power source or from a solar panel 119 mounted next to the fire hydrant.

Referring back to FIGS. 7–10, another important aspect of the present invention will be described. The preferred directional/bypass valve 64 is a butterfly valve 120 having a gear drive actuator 122 requiring several turns on a handle (not shown) to open or close the valve. The butterfly valve 120 has a nominal size of at least one (1) denomination larger than the nominal size of the adjoining pipe 22. For example, a butterfly valve having a nominal size of eight (8) inch should be used on a partitioned pipe of six (6) inch or smaller. The directional/bypass valve 64 also comprises an expanding and reducing adapters 124, 126 on the upstream and downstream sides of the butterfly valve 120 respectively.

Each of the adapters 124, 126 has a contoured partition 130 therein. In use, the contoured partitions 130 are joined to the partition 24' in the adjoining pipes 22. Again, the joining of the partitions 130 and 24' can take different forms which are not illustrated herein for not being the focus of the present invention. Each contoured partition 130 has a curved edge 132 which is a precise fit around the curvature of the valve's blade 66. This precise fit is preferably a close contact fit but may also form a gap 'D' having a clearance of up to about ¼ inch, without adversely affecting the performance of the forced flow circulation systems according to the present invention. It is believed that a gap 'D' of 1/16 inch will allow only about 10% of the flow in the upstream pipe half to traverse there through. This flow loss increases to 18–20% with a gap size 'D' of ⅛ inch, and to about 30% with a gap 'D' of ¼ inch. These secondary flows across the valve are shown as labels 138 in FIG. 9. This belief is also based on theoretical pressure loss calculations made using principles and instructions found in the aforesaid engineering manual entitled: Fundamentals of Fluid Mechanics. It will be appreciated that such loss of flow across the valve does not compromise the effectiveness of the circulation systems according to the first and second preferred embodiments.

Figure 8:
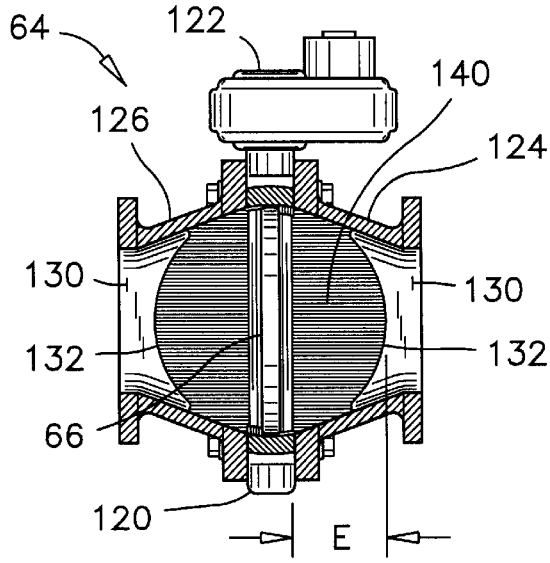
FIG. 8 is a cross-section side view of the directional/bypass valve in a closed position.
Figure 9:
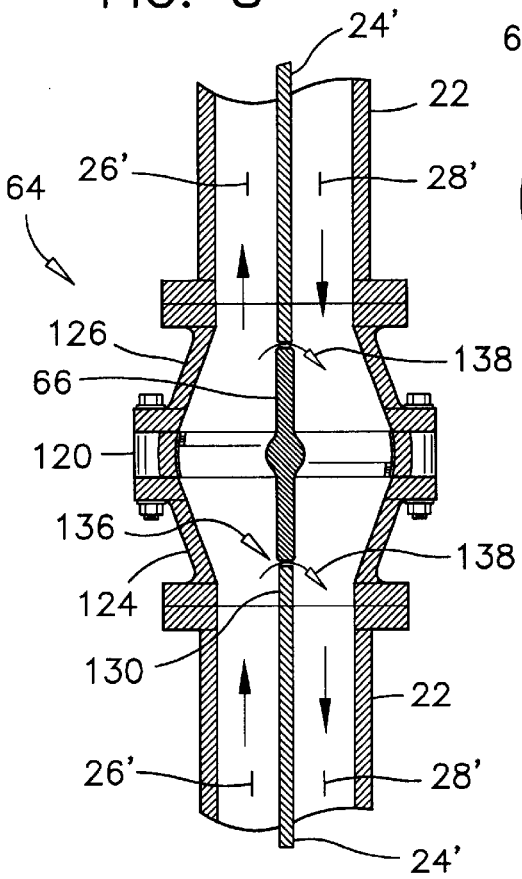
FIG. 9 is a cross-section top view of the directional/bypass valve in a directional mode.
Figure 10:
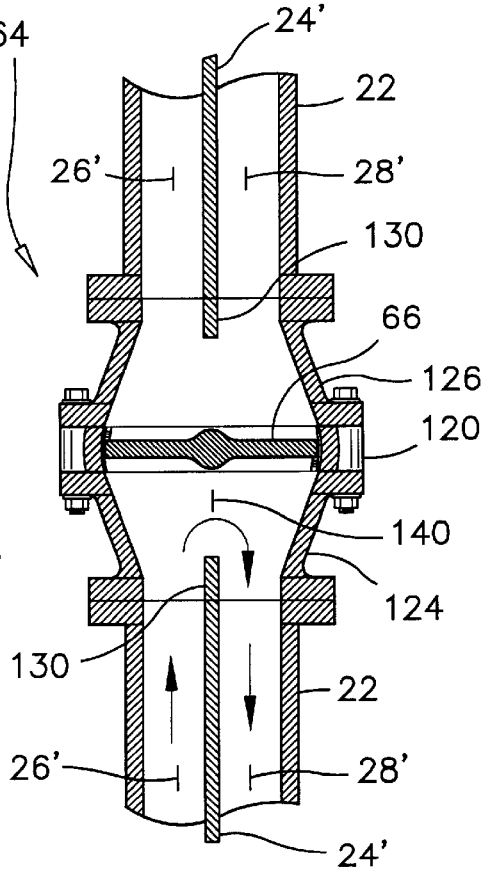
FIG. 10 is a cross-section top view of the directional/bypass valve in a bypass mode.

When the valve 64 is open, such as illustrated in FIGS. 7 and 9 in particular, the flow of water in both pipe halves of the partitioned pipe 22 are respectively directed across the valve. When the valve is closed, as illustrated in FIGS. 8 and 10, the blade 66 isolates the upstream end of the hydrant lateral 22 from the downstream end, and opens a return path 140 across both pipe halves 26', 28', thereby allowing a flow of water from one pipe half to the other. Because the size of the butterfly valve 120 is one (1) denomination larger than the nominal size of the pipe 22, the height and width 'E' of the return gap 140 define a bypass area which is substantially larger than the cross-section of one pipe half 26' or 28' of the partitioned pipe 22. The flow through the return gap 140 is thereby minimally restricted. When the valve blade 66 is closed, the hydrant base 68 is isolated from the branch pipe 20 or 80 and the flow of water is maintained substantially undiminished along the branch pipe 20 from which the hydrant lateral depends.

Figure 11:
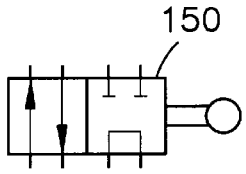
FIG. 11 is a symbol of a four-way spool valve indicating an alternate embodiment of the directional/bypass valve.
Figure 12:
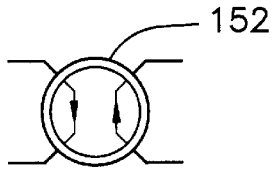
FIG. 12 is a symbol of a four-way ball or barrel valve indicating another alternate embodiment of the directional/bypass valve.

For the practicality of the design, the preferred directional/bypass valve 64 has been described as a butterfly valve 120 enclosed between two partitioned adapters 124, 126. Such a butterfly valve is readily available commercially, and it is believed that the manufacturing of the adapters 124, 126 does not present any difficulties for the person skilled in the art. However, it will be appreciated that this particular design is not essential to the operation of the circulation systems according to the present invention. Other types of valve can be used to perform the same function. As a first example, it is known that a spool valve, as illustrated by the symbol 150 in FIG. 11 can be made to provide directional and bypass features as previously described. As a second example, it is known that a ball valve or a barrel valve as represented by the symbol 152 in FIG. 12 may also be made and used to obtain the same function as the butterfly valve 120 and the adapters 124, 126. And of course, one may also consider the use of a pair of gate valves or other combination valves connected in parallel, with a third valve mounted across their upstream sides.

As can be appreciated, the circulation systems described in the first and second preferred embodiments are made with components that are readily available or easily manufacturable. The configuration of these systems does not depart from common water piping technologies. It is believed that the capital cost for designing and installing a circulation system according to the concepts and principles described in these preferred embodiments is similar to the current prices paid by municipalities for building conventional piping systems.

Figures 13, 14:
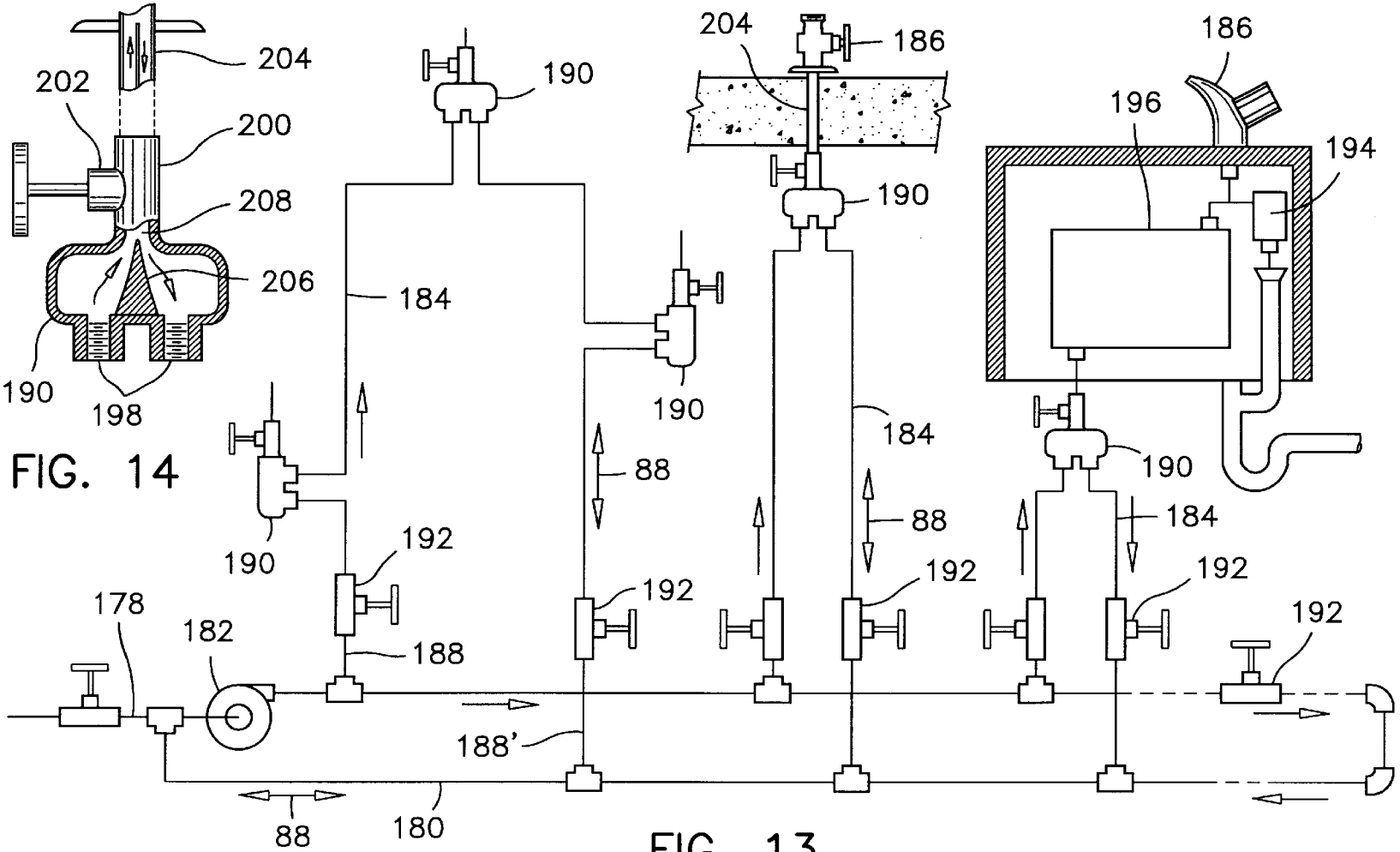
FIG. 13 is a diagram of a potable water circulation system according to the third preferred embodiment of the present invention for circulating domestic water in the piping system of a building.
FIG. 14 is a valve header used at some of the water outlets in the water circulation system shown in FIG. 14.

Referring now to FIG. 13, a schematic diagram of a potable water circulation system according to a third preferred embodiment of the present invention is illustrated therein. This third preferred embodiment is adapted to circulate water in the potable water distribution system of a building. This system comprises a water inlet pipe 178, a loop pipe 180 connected to the water inlet pipe 178, and a pump 182 mounted in series with a primary loop pipe 180 to circulate the water in the primary loop pipe. A plurality of secondary takeoff loops 184 or secondary loop pipes, are connected to this primary loop pipe 180 to feed various water outlets 186 such as an outdoor tap and a drinking fountain for examples. Each of the secondary loop pipes 184 has a U-like shape with a pair of leg pipes 188, 188' connected to diametrically opposite sides of said primary loop pipe 180. Each outlet is connected to a valve header 190 connected to one of the secondary takeoff loops 184. The flow through the primary and secondary loops are controlled by a number of flow control valves 192. This system may also comprise a timer-controlled dumping valve 194 to periodically drain the reservoir 196 of a drinking fountain for example.

The principal feature of this third preferred embodiment consists of the structure of the valve header 190. The valve header has a U-like construction with a main flow along a U-shaped path 198 and a takeoff portion 200 extending from a mid-point on the U-shaped path. A valve 202 is mounted in the takeoff portion for selectively shutting off a flow of water through the takeoff portion 200. A partitioned pipe 204 extends from the takeoff portion beyond the valve 202 to a water outlet such as a faucet.

There is provided a divider 206 extending inside the valve header 190 across the U-shaped path 198 and forming a gap 208 near the valve 202, in a manner which is similar to the previously described gap 'D'. The dimension of this gap 208, however, should be selected to cause a flow along the partitioned pipe 204 of only about 1–5% of the flow along the U-shaped path 198. This structural limitation is advantageous for allowing the installation of several valve headers 190 in series in a same secondary loop 184 without causing significant pressure losses. Also, the flow of water in the primary and secondary loop pipes 180, 184 can be reversed as shown by the double-headed arrows 88 to supply a large demand of water to one of the outlets 186.

While three embodiments of the present invention have been described hereinabove, it will be appreciated by those skilled in the art that various modifications, alternate constructions and equivalents may be employed without departing from the true spirit and scope of the invention. It will also be appreciated that the feature of one embodiment can be used in another and vice-versa. Therefore, the above description and the illustrations should not be construed as limiting the scope of the invention which is defined by the appended claims.

I claim:

1. A potable water circulation system for circulating water in a municipal water distribution network comprising a water main and a branch pipe extending from said water main and having a dead end therein at a distance from said water main, said potable water circulation system comprising:

pump means having a nominal capacity and conduit means connected to said dead end and to said water main for circulating water from said water main to said dead end and back into said water main, and means to cause a minimal circulation of water in said pump and conduit means when a demand in said branch pipe is lower than said nominal capacity, and means to reverse said circulation when said demand exceed said nominal capacity.

2. The potable water circulation system as claimed in claim 1, wherein said conduit means in mounted inside said branch pipe.

3. The potable water circulation system as claimed in claim 1, further comprising a partitioned pipe and a directional/bypass valve along said partitioned pipe.

4. The potable water circulation system as claimed in claim 3, wherein said directional/bypass valve comprises a butterfly valve and a partitioned adapter mounted to each side of said butterfly valve.

5. A potable water circulation system for circulating water in a municipal water distribution network comprising a water main and a branch pipe extending from said water main and having a dead end therein at a distance from said water main, said potable water circulation system comprising:

a first longitudinal partition mounted inside said branch pipe and defining a first and second pipe halves in said branch pipe;

a first gap in said first longitudinal partition at said dead end;

a first and second takeoff pipes connected respectively to said first and second pipe halves and separately to said water main;

a check valve mounted in said first takeoff pipe, said check valve having an unchecked side near said water main and a checked side away from said water main, and a pump having an intake pipe and a discharge pipe connected to said first takeoff pipe, on said unchecked and checked sides respectively;

such that said pump is operable to cause a circulation of water from said water main, into said first pipe half, through said first gap and back to said water main along said second pipe half.

6. The potable water circulation system as claimed in claim 5, wherein said first gap has an area larger than a cross-section of one of said first and second pipe halves.

7. The potable water circulation system as claimed in claim 5, further comprising a fire hydrant lateral connected to said branch pipe, said fire hydrant lateral having a second longitudinal partition therein defining a third and fourth pipe halves there along, a hydrant base defining and end thereof and a second gap in said second longitudinal partition in said hydrant base; said third and fourth pipe halves being in communication with said first pipe half and forming with said first pipe half and said second gap a serial conduit.

8. The potable water circulation system as claimed in claim 7, further comprising a directional/bypass valve mounted in said fire hydrant lateral.

9. The potable water circulation system as claimed in claim 8, wherein said directional/bypass valve has means to direct a flow of water there through along said third and fourth pipe halves and means for bypassing water from one of said third and fourth pipe halves to the other.

10. The potable water circulation system as claimed in claim 9, wherein said means to direct a flow of water there through along said third and fourth pipe halves and means for bypassing water from one of said third and fourth pipe halves to the other comprises a butterfly valve having an upstream side and a downstream side, and partitioned adapters on said upstream and downstream sides.

11. The potable water circulation system as claimed in claim 10, wherein said butterfly valve has a circular blade and each of said upstream and downstream adapters has a contoured partition enclosing a portion of said circular blade.

12. The potable water circulation system as claimed in claim 11, wherein one of said contoured partition forms a gap along said circular blade and said gap is between a contact fit and about ¼ inch clearance.

13. The potable water circulation system as claimed in claim 9, wherein said fire hydrant lateral has a nominal pipe size and said butterfly valve has a nominal valve size, and said nominal valve size is at least one denomination larger than said nominal pipe size.

14. The potable water circulation system as claimed in claim 9, wherein said means for bypassing water from one of said third and fourth pipe halves to the other comprises a return path having an area which is larger than a cross-section of one of said third and fourth pipe halves.

15. The potable water circulation system as claimed in claim 7, wherein said second gap has an area larger than a cross-section of one of said third and fourth pipe halves.

16. A potable water circulation system for circulating water in a municipal water distribution network comprising a water main and a closed loop pipe connected to said water main, said potable water circulation system comprising:

a first and second takeoff pipes connected separately to said water main and to said closed loop pipe;

a first and second check valves mounted in said first and second takeoff pipes respectively, each of said first and second check valves having an unchecked side near said water main and a checked side near said closed loop pipe, a third check valve mounted in said closed loop pipe; said third check valve having an unchecked side near one of said takeoff pipes and a checked side away from said takeoff pipe, and a pump having an intake pipe and a discharge pipe connected to said closed loop pipe astride said third check valve, near said checked side and unchecked side of said third check valve respectively; said pump having a nominal capacity;

such that said pump is operable to cause a minimal circulation of water in said closed loop pipe when a demand of water in and said closed loop pipe is lower than said nominal capacity, and said minimal circulation is reversible when said demand exceed said nominal capacity.

17. The potable water circulation system as claimed in claim 16 further comprising a branch pipe extending from said closed loop pipe and having a dead end therein at a distance from said closed loop pipe; said branch pipe having a longitudinal partition mounted therein defining a first and second pipe halves, and a gap in said first longitudinal partition at said dead end, and said first and second pipe halves and said gap forming a serial conduit with said closed loop pipe.

18. The potable water circulation system as claimed in claim 17, wherein said branch pipe has a directional/bypass valve mounted therein for selectively directing a flow of water along said first and second pipe halves there through, and diverting a flow of water from said first pipe half to said second pipe half.

19. The potable water circulation system as claimed in claim 18, wherein said directional/bypass valve comprises a butterfly valve having a gear drive actuator.

20. The potable water circulation system as claimed in claim 17, further comprising a tee fitting between said branch pipe and said closed loop pipe and said tee fitting having a partition therein intersecting said closed loop pipe.

21. A potable water distribution system for circulating water in a water distribution network of a building having a water inlet pipe; said potable water circulation system comprising:

a primary loop pipe connected to said water inlet pipe;

a pump mounted in series in said primary loop pipe to circulate water in said primary loop pipe;

a secondary loop pipe having a pair of leg pipes connected to diametrically opposite sides of said primary loop pipe;

valve means for circulating a portion of a flow in said primary loop pipe into said secondary loop pipe;

a header having U-shaped flow path connected in series with said secondary loop pipe and a take-off portion extending away from said U-shaped flow path;

a partitioned pipe extending from said take-off portion; said partitioned pipe having an end, a partition therein and a first gap in said partition near said end;

a water outlet connected to said end of said partitioned pipe;

said header having a divider therein aligned with said partition, extending near said partition;

such that a portion of a flow of water in said secondary loop pipe can be circulated near said water outlet for maintaining the water near said water outlet active and fresh.

22. The potable water circulation system as claimed in claim 21, further comprising means for reversing a flow in said primary and secondary loop pipes when a water demand in said water outlet is high.

* * * * *